US005355764A

United States Patent [19]

Marinos et al.

[11] Patent Number: 5,355,764

[45] Date of Patent: Oct. 18, 1994

[54] PLASMA ACTUATED IGNITION AND DISTRIBUTION PUMP

[75] Inventors: Charalampos D. Marinos, Brooklynn Center; James P. Warren, Coon Rapids; Amir Chaboki, Minneapolis; Chris S. Sorensen, Edina; Mark E. Schneider, Minneapolis, all of Minn.

[73] Assignee: FMC Corporation, Chicago, Ill.

[21] Appl. No.: 878,350

[22] Filed: May 4, 1992

[51] Int. Cl.[5] ..... F41B 6/00

[52] U.S. Cl. ..... 89/8; 102/472

[58] Field of Search ..... 89/7, 8; 102/440, 472; 124/3

[56] References Cited

U.S. PATENT DOCUMENTS

| | | | |
|---|---|---|---|
| 4,170,922 | 10/1979 | Peterson | 89/7 |
| 4,895,062 | 1/1990 | Chryssomallis et al. | 89/7 |
| 5,072,647 | 12/1991 | Goldstein et al. | 89/8 |

FOREIGN PATENT DOCUMENTS

| | | | |
|---|---|---|---|
| 382000 | 8/1990 | European Pat. Off. | 89/8 |
| 2355255 | 5/1975 | Fed. Rep. of Germany | 102/472 |
| 958434 | 3/1950 | France | 102/472 |

OTHER PUBLICATIONS

D. C. Cook et al, *Multidimensional Electrothermal Model* Oct. 17, 1989.

Charalampos Marinos et al, *Experimental and Theoretical Investigation of the Combustion Chamber Pressure Waves of an ETC Gun* Oct. 1991.

*Weapon Systems Fundamentals,* vol. 2, Jul. 15, 1960 NAVWEPS OP 3000 pp. 90 and 104.

*Primary Examiner*—Stephen C. Bentley

*Attorney, Agent, or Firm*—G. Wolde-Michael; R. C. Kamp; R. B. Magley

[57] ABSTRACT

The method and apparatus disclosed herein relates to harnessing plasma to ignite, pressurize and distribute plasma, plasma-ignited chemical fluid and fuel throughout a propellant mass. Particularly, the present invention enables the creation of a progressive burning surface whereby the propellant reaches maximum pressure controllably and losses pressure much more slowly thus creating high piezometric efficiency. More particularly, in gun-charge-projectile systems, by using radial perforations designed to provide a balanced plasma discharge through a capillary wall and by developing forward accelerating thrust components, induced by the plasma pressure on a plasma-ignited chemical fluid and fuel mixture, the propelling charge travels down the gun tube with the projectile thus exerting substantial uniform pressure throughout the tube length and yielding a high ballistic efficiency which results in the attainment of high muzzle velocities.

25 Claims, 4 Drawing Sheets

32
30
38
46
42
61
54
43
63
58
61
2A
54
52
44
48
48
64
36
28
16
62
56
34
PFN
2A 61
38
61
61
63
30
58
43
42

32
30
43c
58c
54
52
54
48
47
36
62
28
16
56
34
PFN

PLASMA ACTUATED IGNITION AND DISTRIBUTION PUMP

BACKGROUND OF THE INVENTION

1. Field of the Invention

This invention relates to plasma actuated ignition and distribution pump. Specifically, the plasma element is used to provide high temperature for ignition and high pressure for distribution of plasma-ignited chemical fluid and fuel throughout a propellant mass.

2. Description of the Prior Art

U.S. Pat. No. 4,895,062 Chryssomallis et al discloses a typical ammunition for use in a Combustion Augmented Plasma (CAP TM) Gun, wherein high temperature and high pressure are created in a capillary using a high voltage source such as a Pulse Forming Network (PFN). The plasma thus created is injected through a gun breech block into a gun cartridge to ignite a propellant, augment combustion and fire a round. The plasma is primarily used to control combustion thus providing increase in muzzle velocity of a projectile while reducing peak value of gas pressure inside a gun barrel. In this prior art, the capillary and the plasma generation apparatus are set in the gun breech block and remain inside the gun as successive projectiles are launched from the gun.

Further, U.S. Pat. No. 4,711,154 Chryssomallis et.al discloses a propulsion or pressure amplification system in which a dielectric plasma serves as a pump means to deliver fuel to an oxidizer chamber. In this prior art, unlike the present invention, the use of plasma to ignite and distribute combustion throughout the propellant is not spatially balanced. Particularly, plasma ignition is limited to a point source and is not distributed in a piezometrically efficient manner to provide near complete ignition.

The present invention is distinguished from the prior art and provides several advances and advantages. Among the distinguishing features include harnessing plasma not only to ignite a propellant and augment combustion, but also to pressurize and to distribute plasma-ignited chemical fluid and fuel throughout the propellant. Further, the present invention promotes significant advances over the prior art by creating a progressive burning surface which enables the propellant to reach maximum pressure levels and sustain these levels in a controllable manner thus attaining high piezometric efficiency, which is the ratio between the mean pressure and the peak pressure. Moreover, in gun-charge-projectile systems, by balancing the plasma discharge into a propellant mass and by developing forward thrust components, the present invention enables acceleration of the plasma-ignited chemical fluid, fuel and propellant mixture down the gun tube and exerts substantially uniform pressure throughout the length of the gun tube to thereby provide high ballistic efficiency, which is the ratio of the total work done on the projectile to the total work potential of the burning chemical. The combined effect of high piezometric and ballistic efficiencies yield, inter alia, high energy output and high muzzle velocity. Heretofore, high explosion and detonation undermine the attainment of high piezometric and ballistic efficiency in an impulse propulsion system in which a chemical and electric energy are used to create propulsive forces and pressure for accelerating a projectile in a gun tube. As will be discussed herein below, the present invention eliminates these problems and enables optimization of the total work potential of the propellant as well as creation of a uniform pressure profile by attenuating erratic peak pressures.

SUMMARY OF THE INVENTION

Accordingly, several objects and advantages of the invention are to provide a method and apparatus to minimize chamber pressure in a combustive media, for example such as in gun propulsion systems, and to create substantially flat pressure versus time and travel performance profiles thus increasing the ballistic and piezometric efficiency of the gun-charge-projectile or of the propulsion system.

Another object of the present invention is to provide apparatus which enables complete mixing of plasma with a propellant by controllably using plasma pressure to create distributed ignition at predetermined segments throughout the propellant mass.

Yet another object of the invention is to create and to pump a spatially distributed plasma-ignited chemical fluid and fuel front into a propellant mass. This provides ignition to the propellant by high temperature plasma rather than by shock thus avoiding undesirable detonative combustion which yield extremely high pressure spikes. Accordingly, efficient ignition and near complete combustion are achieved by distributively pumping plasma-ignited chemical fluid throughout the propellant mass.

To achieve the above objects, there is provided consonant with the present invention an improved electrothermal-chemical impulse propulsion system of the type comprising a capillary with a first and second end where an anode terminal is disposed in the first end and a cathode terminal is disposed in the second end. A fuse wire connects the anode to the cathode and a pulse forming network (PFN), for creating high voltage across the fuse wire, for plasma generation is provided. Means forming a fuel chamber surrounds the capillary and means forming an oxidizer chamber contiguous to the fuel chamber and the capillary are also provided. The improvement comprises a plurality of perforations in the capillary wall in addition to a diaphragm or membrane means for segregating the capillary and the fuel chamber from the oxidizer chamber. The improvement further comprises means for deflecting the plasma to thereby pressurize and pump the plasma through said perforations into the adjacent fuel chamber.

In another aspect of the invention, a plasma actuated ignition and distribution pump is disclosed wherein plasma is generated by means of a pulse forming network voltage source and a fuse wire extending between two electrodes. The plasma thus created is discharged to permeate and ignite a fuel mass in a contained volume. Further, plasma pressure is used to pump plasma-ignited chemical fluid and fuel into a propellant thereby controlling the mixing rate and therefore the rate of reaction and enhancing piezometric and ballistic efficiencies of the electrothermal-chemical impulse propulsion system. Particularly, the ignition and distribution system comprises a capillary wall having a bore therethrough with a first and a second end forming a fuel containment means defining a closed volume and having a plurality of perforations through said wall. Further, the system comprises means forming an inlet at said first end for allowing the plasma to discharge into said capillary and means for deflecting plasma and creating plasma pressure in said capillary. Additionally, means forming an oxidizer chamber, contiguous to the capillary is also provided.

Yet another aspect of the present invention discloses a plasma actuated ignition and distribution pump with contiguous air, fuel and oxidizer chambers. The assembly includes an ignition and distribution system comprising a central capillary having a first and a second end forming the air chamber and further having a wall and perforations through said wall. A chamber defining a first closed volume having a wall and having perforations in the wall forms the fuel chamber surrounding the air chamber. Additionally, a housing means forms the oxidizer chamber defining a second closed volume and is disposed surrounding the fuel chamber. A plasma generation means is also contained in the central capillary.

The present invention further discloses a plasma actuated ignition and distribution pump in which a capillary wall having a bore with first and second ends defining a closed volume therebetween is used to contain and distribute plasma, through perforations in the capillary wall, to ignite and pump plasma-ignited chemical fluid and fuel into a propellant. The invention comprises, in essential parts, plasma generation means which includes a pulse forming network for high voltage supply having connections to a fuse wire extending between electrodes and means for injecting plasma into the capillary at said first end. A propellant container means forming a closed volume surrounds the capillary and a coupling means for plasma deflection further forms an enclosure at said second end.

Furthermore, the present invention discloses a method of pumping and distributing plasma, plasma-ignited chemical fluid and fuel into a propellant to create high piezometric and ballistic efficiencies in an impulse propulsion system, for launching a projectile, having a capillary tube with a wall having perforations therethrough with membranes covering said wall perforations. The method includes the steps of creating high temperature and high pressure plasma into the capillary tube. Further, the plasma is discharged axially in the capillary tube and is deflected to build pressure in the capillary for rupturing the membrane covering the perforations. Moreover, a dielectric substance or ablative layer applied to the interior surface of the capillary tube is ablated by the plasma to thereby form a plasma-ignited chemical fluid in the capillary. Accordingly, the plasma introduced through the ruptured perforations comprises a plasma-ignited chemical fluid which is used to permeate a fuel and or a propellant mass disposed outside said capillary. By pulsating and energizing the plasma via a high voltage pulse forming network (PFN) means, to sustain a predetermined plasma pressure within said capillary and by pumping said plasma to ignite the fuel and or propellant and to distribute plasma-ignited chemical fluid throughout the fuel and or propellant, the disclosed method creates a progressive burning surface. Accordingly, by creating the progressive burning surface and accelerating a plasma-ignited chemical fluid, fuel and or propellant mixture train down the gun barrel both the piezometric and the ballistic efficiencies of the impulse propulsion system are optimized.

DESCRIPTION OF THE PREFERRED EMBODIMENT

The method and apparatus for the plasma actuated ignition and distribution pump disclosed herein combines the advantages of high pressure plasma ignition and distribution throughout a propellant mass to optimize both ballistic and piezometric efficiencies of an impulse propulsion system. Particularly, by harnessing plasma to ignite, pressurize and distribute plasma-ignited chemical fluid and fuel throughout the propellant mass, a progressive burning surface is created which is conducive to a complete and non-erratic burning of the propellant thereby resulting in high energy yield and high muzzle velocity. Accordingly, some of the most distinguishing features of the present invention are discussed herein below.

Figure 1A:
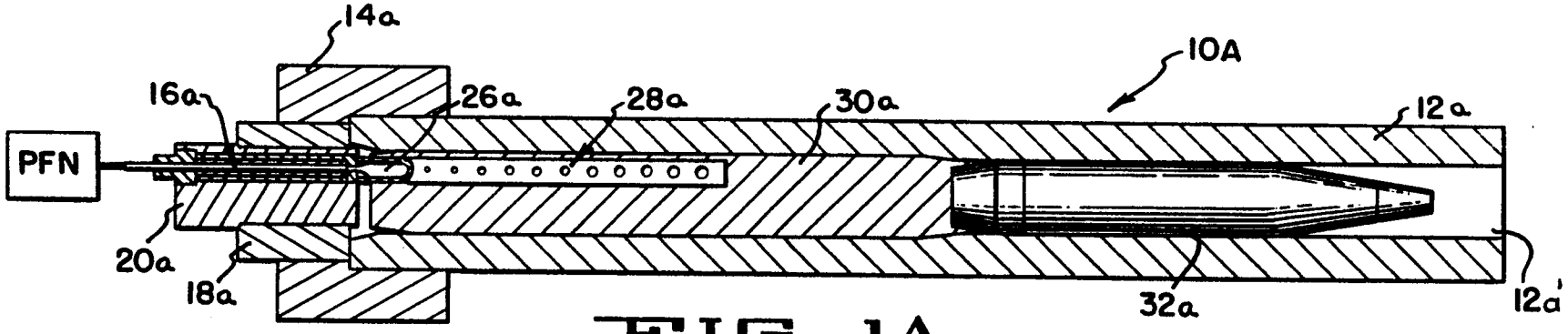
FIG. 1A is a central section depicting a gun breech block with a gun tube and an externally mounted plasma generation system integrated with a cartridge and a projectile.
Figure 1B:
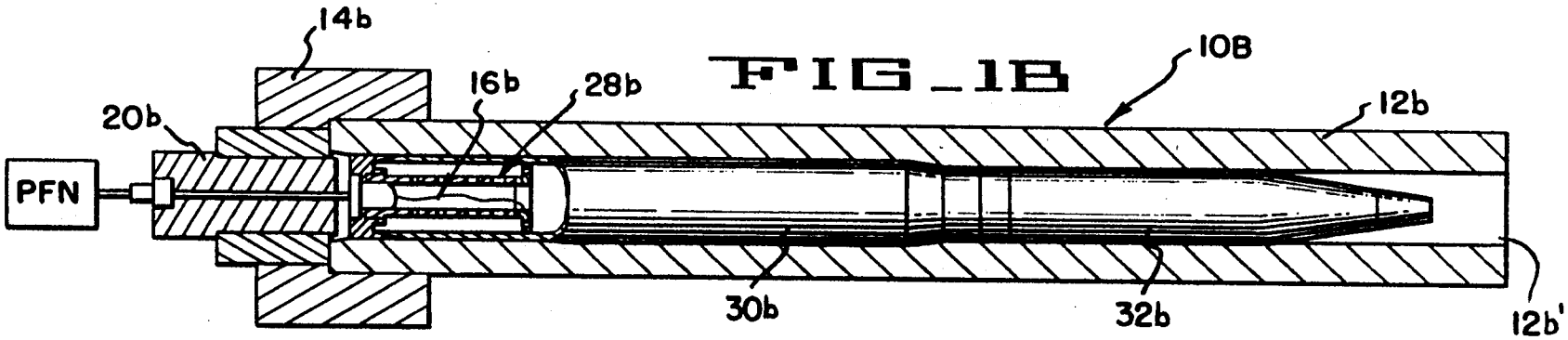
FIG. 1B is a central section depicting a gun breech block with a gun tube and an internally mounted plasma generation system integrate with a cartridge and a projectile.

Referring now to FIGS. 1A and 1B, embodiments of electrothermal-chemical gun 10A and 10B are shown. FIG. 1A depicts a gun barrel **12*a* and bore 12*a'* with a breech block 14*a*. A plasma generation system 16*a* is mounted at the breech block 14*a*. An adapter sleeve 18*a* accepts a support collar 20*a* which provides structural support to the plasma generation system 16*a*. The plasma generation system 16*a* is supplied high voltage, controllably and adaptively designed for specific energy output levels, by power supply from a pulse forming network (PFN). Plasma generated in the generation system 16*a* is discharged through an orifice 26*a* into an ignition and distribution pump 28*a*. The ignition and distribution pump 28*a* is disposed in a cartridge 30*a*. The cartridge 30*a* is integrally coupled to a projectile 32*a*. Hence, the structure of FIG. 1A depicts a plasma generation system 16a externally mounted to the ignition and distribution system 28a. In contrast, FIG. 1B depicts a plasma generation system 16b mounted inside the ignition and distribution system 20b with power supplied from a pulse forming network (PFN). In this structure, the plasma generation system 16b is integrated with the ignition and distribution system 28b** and consequently there is no need for a plasma discharge orifice.

Figure 2:
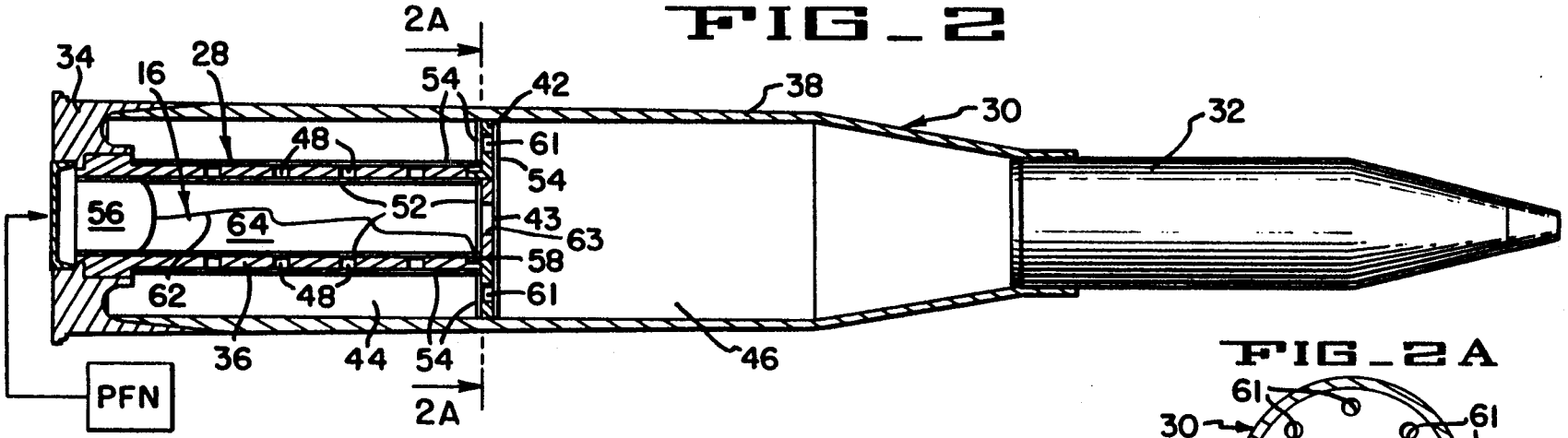
FIG. 2 is a central section of an embodiment of the plasma actuated ignition and distribution pump incorporated in a cartridge round.

Referring now to FIG. 2, an embodiment is shown comprising a cartridge 30 to which a projectile 32 is integrally attached. The cartridge 30 further comprises a stub case 34 providing structural support and containment at the base. The cartridge 30 is partitioned into chambers including a plasma generation system 16 disposed in one of the chambers comprising an ignition and distribution pump 28 which includes a capillary 36 having first and second ends with the first end integrally secured at the stub case 34, and the second end attached to cartridge housing 38. Particularly, the capillary 36 includes a flange end 42 which divides the cartridge 30 into chambers wherein a fuel chamber 44 is formed around the capillary 36 and an oxidizer chamber 46 is formed forwardly contiguous to the plasma generation system 16.

The capillary 36 is generally made of a dielectric substance, for example, reinforced composite material of a commercial structural grade. The capillary 36 further comprises perforations 48 radially and longitudinally distributed in a generally uniform layout in the wall of the capillary 36. The wall of the capillary 36 includes an internal ablative layer 52 and an external membrane cover 54. The external membrane 54 acts as a barrier to thereby segregate the contents of the capillary 36 from the surrounding fuel chamber 44 and the oxidizer chamber 46. Further, an anode terminal 56 is internally disposed at one end of the capillary 36 and a cathode terminal 58 is integrally formed with the flange end 42. A fuse wire 62 extends between the anode 56 and the cathode 58 in the capillary bore 64. The cathode 58 comprises a cylinder piece coextensively integrated with the capillary 36 and forming a part of the flange end 42. A pule forming network (PFN) provides high voltage at the anode terminal 56, having rigid connections at the center section of the stub case 34. The bore 64 is defined by the wall of the capillary 36 and the space formed between the anode 56 and an end plate 43, forming the second end of the capillary 36, wherein a dielectric fluid, e.g., air, is contained. The end plate 43 forms a terminal barrier and is integrally joined to the cathode 58 and the flange end 42. Further, the flange end 42 comprises outlet ports or perforations 61 which are radially spaced apart and coaxial with the longitudinal axis of the capillary 36.

Figure 2A:
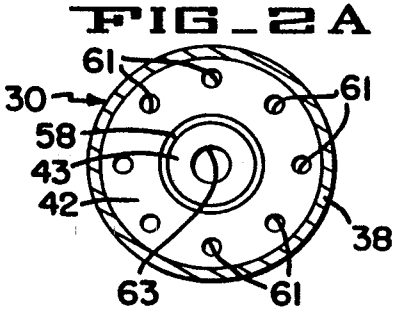
FIG. 2A is cross-sectional view of an end plate taken along lines 2A—2A of FIG. 2 which divides the plasma capillary, the fuel chamber and the chemical chamber. The end plate is shown with circumferencially and centrally located orifices.

An alternate embodiment of the flange end 42 and the end plate 43 is shown in FIG. 2A. In this embodiment, the end plate 43 comprises an orifice 63 to discharge plasma directly into the oxidizer chamber 46. As will be discussed herein below, in certain preferred embodiments this structure attenuates core ignition lag by injecting a limited stream or a portion of primary plasma. Particularly, in propellants with high viscosity and density where core ignition lag results in incomplete or detonative burning, the discharge through the orifice 63 utilizes plasma as a primer igniter for the propellant by raising the core temperature to thereby promote efficient combustion.

The disclosed structure relative to the embodiment shown in FIG. 2 can be designed to accommodate the plasma ignition and distribution needs of a given gun system. The operational sequence for the device of FIG. 2 is initiated by supplying electrical energy comprising high voltage and high power at the anode terminal 56. The electrical energy discharges into the capillary 36 thereby ionizing the fuse wire 62 and the air contained in the bore 64, thereby forming plasma. The plasma thus formed would normally flow in a direction substantially coincident with the longitudinal axis of the capillary 36, however the end plate 43 deflects and forces the plasma to flow radially. The plasma skims the internal walls of the capillary and thereby progressively and erosively consumes the ablative layer 52. Further, the plasma is spatially distributed without interfering and disturbing the ionized plasma's electrically conductive path at the center of the bore 64. The ablative layer 52 is preferably a dielectric substance, e.g., polyethylene or an equivalent electrically insulating, combustible substance comprising a long chain hydrocarbon polymer. Accordingly, the plasma is replenished with combustible constituents such as carbon and hydrogen as it ablatively erodes the layer 52. More particularly, the power supply P is designed to produce sufficient plasma discharge energy, for example, power levels in the order of one or more Gegga Watts and discharge energy of several Mega Joules creating plasma temperature in excess of 30,000° K. are not uncommon. Thus, the plasma discharge has sufficient energy to readily consume the ablative layer 52 and combustive pressure reaches a few kilo bars inside the capillary. The pent up pressure ruptures the membranes 54 at the perforations 48 and mixes plasma discharge from the capillary 36 with the fuel in the fuel chamber 44. Particularly, the perforations 48 have variable orifice sizes streamlined to enable a near uniform plasma discharge along the longitudinal wall of the capillary 36. This feature enables complete ignition and plasma permeation of the fuel in the fuel chamber 44 and promotes near complete mixing of the plasma-ignited chemical fluid with the fuel.

One of the significant aspects of the present invention is the creation of a moving train of a progressive burning surface. Specifically, the mixture of plasma-ignited chemical fluid and fuel from the fuel chamber 44 burns through the membrane cover 54 and discharges through the orifice 61 into the contiguous oxidizer chamber 46. The mixing of the plasma-ignited chemical fluid and fuel with the oxidizer presents a multiphase hydrodynamic element which yields combustion pressure waves. Mathematical simulation, using two-dimensional (2D) Axisymmetric Codes, have shown that pressure waves observed in previous work are hydrodynamic in origin. One of the objectives of this invention is to attenuate or totally suppress these waves in order to enhance combustion and avoid erratic pressures and detonative combustion. Particularly, assignee has conducted several theoretical studies to determine kinetic and thermal energy predictions of a multiphase hydrodynamic mixing in an environment comprising electrothermal-chemical combustion. Assignee's papers on *A Multidimensional Electrothermal Model* by D.C. Cook et.al, Oct. 17, 1989 and *Experimental and Theoretical Investigation Of The Combustion Chamber Pressure Waves of An ETC Gun* by Charalampos Marinos et.al. October 1991, show that thermal energy is released after plasma-ignited chemical fluid mixes with fuel and with propellant such as the oxidizer in chamber 46. Further, the models predict the experimentally observed pressure in the oxidizer chamber 46 and indicate the resultant piezometric and ballistic efficiencies for the system. Consistent with these mathematical models and studies the present invention maximizes ballistic efficiency by permeating a propellant mass, such as an oxidizer in the oxidizer chamber 46, with plasma-ignited chemical fluid and fuel thereby creating a progressive burning chemical surface throughout the propellant and pumping a plasma-ignited, spatially distributed chemical fluid and fuel front over a substantial segment of the gun tube. More specifically, a distributive ignition train actuated and pumped by the plasma pressure is created, comprising high temperature and high pressure plasma and plasma-ignited chemical fluid and fuel discharges into a propellant mass such as the oxidizer in the oxidizer chamber 46, thereby developing a traveling charge in the gun tube.

Figure 3:
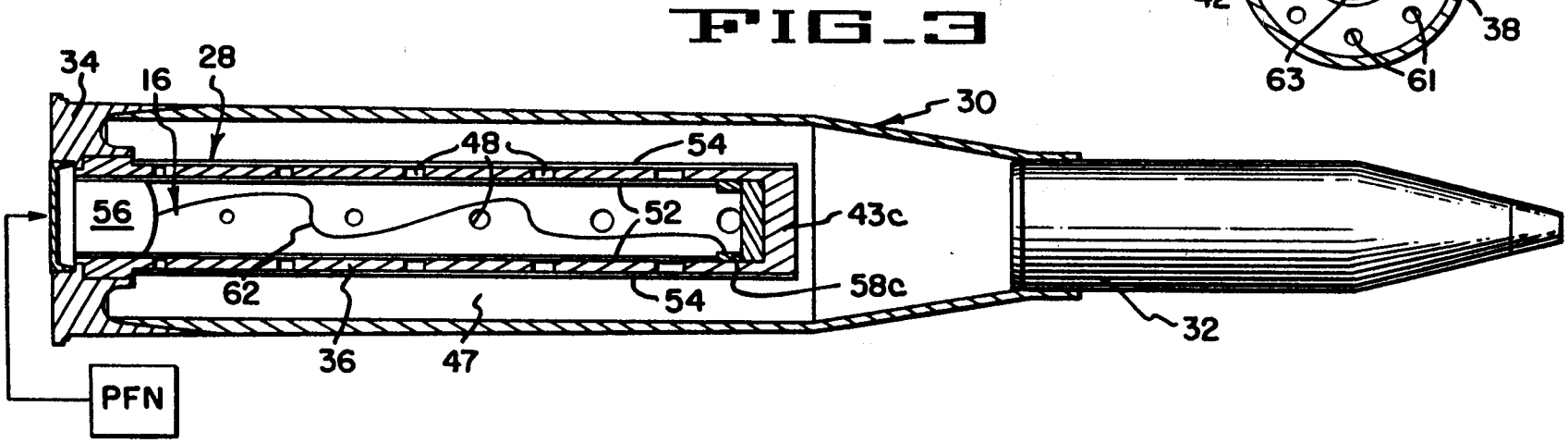
FIG. 3 is a central section of another embodiment of the plasma actuated ignition and distribution pump incorporated in a cartridge round.

FIG. 3 shows another embodiment of the plasma actuated ignition and distribution system in a chemically homogeneous or monopropellant combustible media chamber 47. The ignition and distribution pump 28 is designed to extend further into the combustible media chamber 47. This structure is adaptable to large gun systems with a long propellant architecture where the distribution of ignition and combustion must extend farther out into the propellant. In the structure of FIG. 3, the ignition and distribution pump 28 is supported at the stub case 34 and cantilevers out and extends into the surrounding propellant chamber 47. The end plate 43*c* is made of heavier gage ablative substance to provide rigidity as well as deflect plasma, in the manner discussed hereinabove. A plasma generation system 16 is integrated with the ignition and distribution system 28. An anode terminal 56 and a cathode terminal 58*c* are shown with a fuse wire 62 extending therebetween. The cathode plate 58*c* forms a cylinder integrally set to engage the end plate 43*c* having a peripheral extension to further engage the interior wall of the capillary 36.

Figure 4:
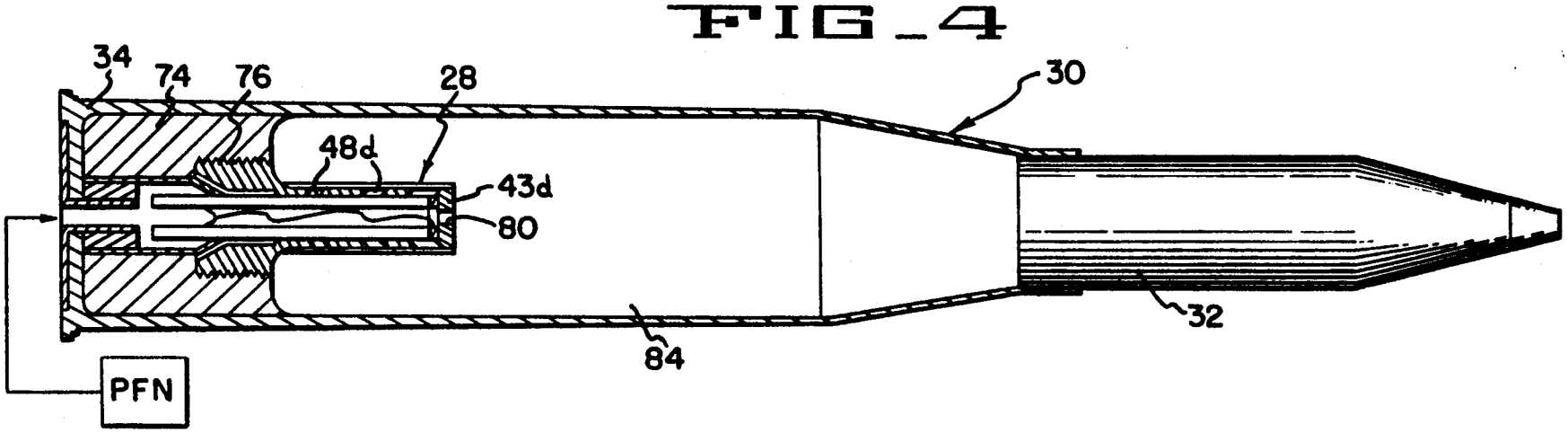
FIG. 4 is a central section of yet another embodiment of the plasma actuated ignition and distribution pump incorporated in a cartridge round.

FIG. 4 shows yet another embodiment wherein the ignition and distribution pump 28 is threadably attached to a cartridge base 74 at a threaded connection 76. The end plate 43*d* has a centrally located orifice 80 to discharge a portion of plasma into the propellant chamber 84. This structure and arrangement enables preheating of the central core of the propellant while plasma-ignited chemical fluid, discharging radially under plasma pressure from the radial holes 48*d*, ignites and accelerates the propellant mass 84 forward. The radial holes 48*d* comprise outlets with a forward and rearward orientation to enable a balanced plasma-ignited chemical fluid flow into both the forward and backward segments of the propellant 84.

Figure 5:
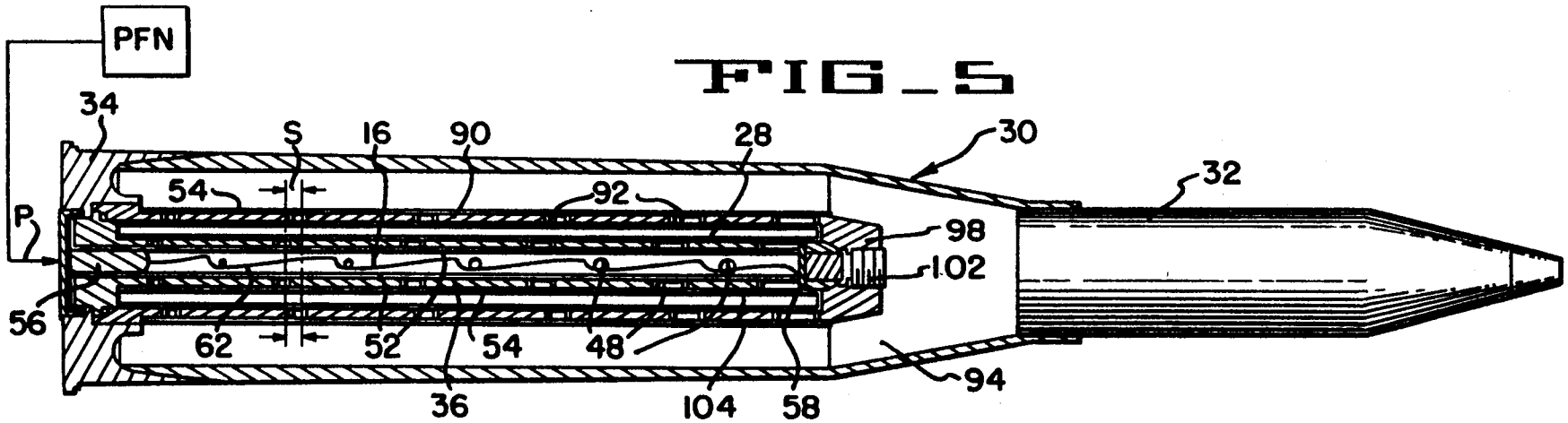
FIG. 5 is a central section depicting a different architecture and embodiment of the plasma actuated ignition and distribution pump incorporated in a cartridge round.

FIG. 5 further shows another embodiment in which the ignition and distribution pump 28 is surrounded by an outer capillary 90 having perforations 92. The inner capillary 36 comprises perforations 48 which are staggered at intervals "S" relative to the perforations 92. The assembly is supported at its first end on the stub case 34 and forms a cantilevered projection into a propellant chamber 94. Further, at its second end the assembly comprises a truncated conical piece 98, having a threaded bore, integrally attached to the outer capillary 90. A plug 102 is threadably inserted into the threaded bore of the conical piece 98 to thereby form a closed end and to isolatively plug the ends of the inner capillary 36 and the outer capillary 90. An anode terminal 56 and a cathode terminal 58 are disposed in the capillary 36 with a fuse wire 62 extending therebetween and thereby forming the plasma generation system 16. When power P is supplied at the anode terminal 56, electrical current passes through the fuse wire 62 which is vaporized forming an ionized plasmatic media in the capillary 36. The plasma discharges in a direction substantially coaxial with the capillary 36 until it impacts the closed end of the conical piece 98 and is deflected in a reverse direction and migrates outwardly skimming the inner ablative layer 52 of the capillary 36 and thereby forms a plasma-ignited chemical fluid. Consequently, as the power supply is sustained and plasma pressure builds to a predetermined level in the capillary 36, the plasma pressure ruptures the membrane cover 54 and the plasma-ignited chemical fluid discharges through perforations 48 to mix with fuel in the fuel chamber 104.

The plasma temperature can be controlled, to an extent, by the type of material used to form the wall of the capillary 36. Specifically, when the wall of the capillary 36 is ablated, in conjunction with the inner ablative layer 52 during plasma discharge, a portion of the wall evaporates. Unlike the inner ablative layer 52 which evaporates completely, the wall of the capillary 36 evaporates partially thereby forming a wall of vaporization arc around the plasma within the capillary 36. The plasma is therefore enclosed by a wall of vaporization arc with a structural integrity to contain the plasma while at the same time ablatively supplying fuel constituents to it. Accordingly, the wall material of capillary 36 can be selected to ablate and evaporate partially at a predetermined rate such that the plasma temperature can be set between 25,000° K. to 30,000° K. Further, the wall material of the capillary 36 can be selected to have chemically reactive constituents compatible with a propellant or oxidizer, such as the oxidizer in chamber 94, so that when the plasma-ignited chemical fluid discharges through perforations 48 and mixes with, for example, fuel in the fuel chamber 104, the ablated vapors enhance combustion and energy generation of the plasma-ignited chemical fluid and the fuel mixture. The plasma-ignited chemical fluid mixes with the fuel in the fuel chamber 104 forming a mixture of plasma-ignited chemical fluid and fuel. Similarly, the pressure in this mixture builds to a critical point and ruptures the membrane cover 54 at perforations 92. Consequently, the plasma-ignited chemical fluid and fuel mixture, urged and actuated by plasma pressure from the inner capillary 36, further invades propellant chamber 94. In the preferred embodiment, this arrangement is used for slow burning chemicals or solid propellants with segmented burning tendencies. The significant advantage of the structure is it affords plasma-ignited chemical fluid and fuel to be mixed and distributed throughout a propellant mass such that a forwardly advancing ignition front with forward acceleration and energy components are created. The resultant forward travel of the propellant mass and the advance of an ignition train comprising said plasma-ignited chemical fluid and fuel create a traveling charge down the gun tube. This yields a near complete combustion of the propellant mass which in turn yields high energy yields per unit mass of propellant.

Figure 6:
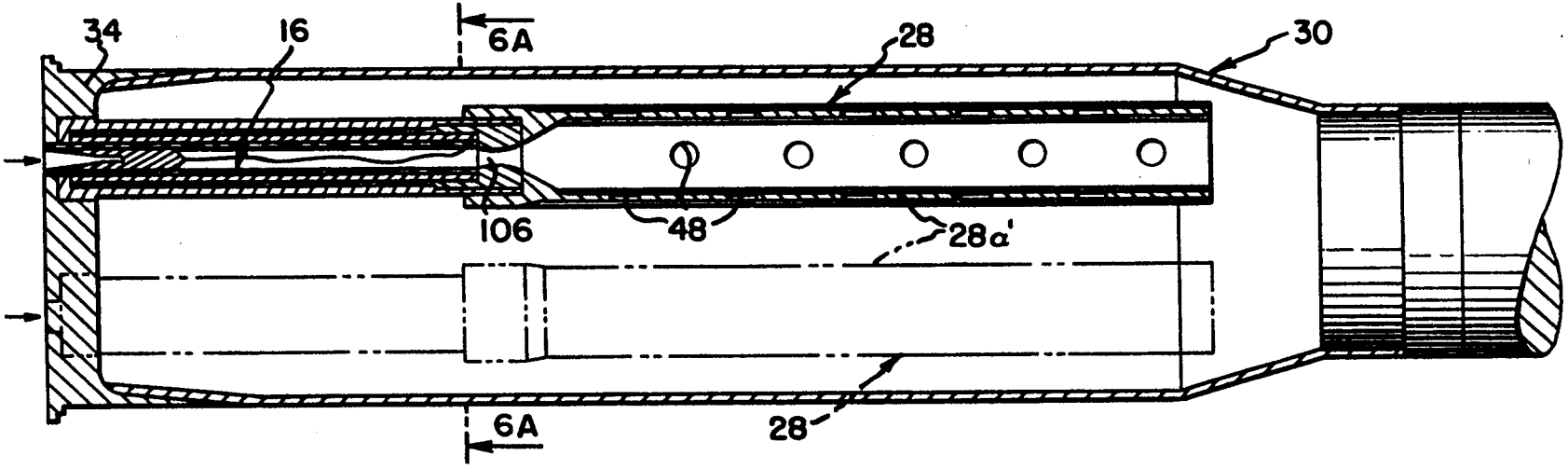
FIG. 6 is a central section of an externally mounted plasma source forming the plasma actuated ignition and distribution pump depicting a plurality of plasma injection means incorporated in a cartridge round.
Figure 6B:
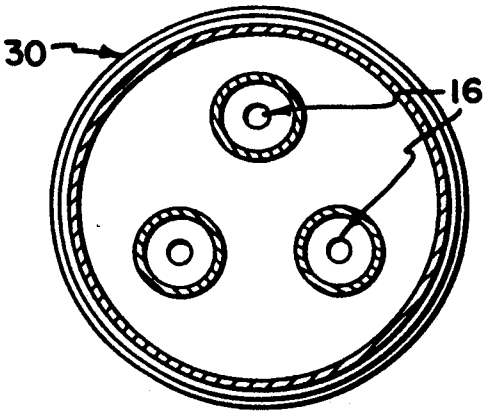
FIG. 6B is a view similar to 6A showing yet another configuration of plasma injection means incorporated in a cartridge round.
Figure 6A:
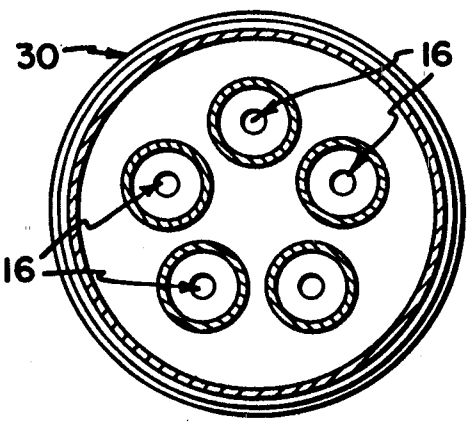
FIG. 6A is a cross section taken along lines 6A—6A of FIG. 6 showing a configuration of a plurality of plasma injection means incorporated in a cartridge round.

FIG. 6 shows a system for a large caliber gun, for example 155 mm or larger, where the ignition and distribution system 28 is integrated in a cartridge 30. Primarily, a plurality of ignition and distribution systems 28 comprising distribution pump or hollow tubes 28*d* with radial perforations 48 are integrally coupled to a plurality of plasma generation systems 16. Transfer nozzles 106 are used to direct plasma into hollow tube 28a'. As shown in FIGS. 6A and 6B, arrangements ranging from a single unit to a multiplicity of units may be constructed depending upon the gun size and the power required to accelerate a projectile.

Some of the significant advantages of the disclosed structure and method comprise the segregated storage of fuel and oxidizer in a cartridge until mixing takes place during the firing of the gun. The rate of mixing between the segregated fuel and oxidizer and the rate of combustion are controlled by the plasma pressure and discharge rate of the plasma-ignited chemical fluid through the perforations of the capillary 36. Further, as discussed hereinbefore, the plasma pressure and the attendant-plasma-ignited chemical fluid discharge rate are controlled by the power supply, capillary geometry and material of construction, fuel and oxidizer type and volume, and the distribution, size and geometry of the perforations in the wall of the capillary 36.

The advances and advantages of the disclosed invention therefore include the creation of a distributive accelerating ignition train, comprising a plasma-ignited chemical fluid and fuel mixture, which enables a propellant mass to acquire a near complete combustion as well as imparts to the propellant mass sufficient energy to provide traveling capability down the gun tube thereby maintaining near constant high pressure in the gun tube thus optimizing piezometric and ballistic efficiencies of the electrothermal-chemical gun system.

Although the best modes have been herein shown and described, it will be apparent that modifications, variations, additions or omissions may be made without departing from what is considered to be the substance and subject matter of this invention.

What is claimed is:

1. An improved electrothermal-chemical impulse propulsion system for accelerating a projectile in a bore of a barrel of the type comprising a capillary having a first and a second end:

an anode terminal disposed at said first end of said capillary;

a cathode terminal;

a fuse wire connected to and extending from said anode terminal and connected to said cathode terminal;

a pulse forming network (PFN) means for creating a plasma discharge across said fuse wire;

a fuel chamber; and means forming an oxidizer chamber contiguous to said fuel chamber and said capillary wherein the improvement comprises:

means for developing controllable plasma pressure for distribution of said plasma discharge in a direction having radial and axial components relative to said bore;

said means for developing controllable plasma pressure further including variable size perforations spaced along a surface of the capillary: and means for separating the capillary, said perforations in the capillary, the fuel chamber and the oxidizer chamber.

2. The improved electrothermal-chemical impulse propulsion system of claim 1 wherein said means for separating said capillary, said fuel chamber and said oxidizer chamber further separates outlet nozzles for plasma-ignited fuel to be forwardly pumped and discharged therethrough.

3. A plasma actuated ignition and distribution pump wherein high voltage is introduced by means of a pulse forming network (PFN) and a fuse wire extending between an anode and a cathode terminal to create a plasma discharge in order to permeate and ignite a fuel mass with the plasma and pump plasma-ignited fuel into a propellant mass to thereby enhance combustion in an electrothermal-chemical impulse propulsion system comprising:

a capillary having a bore therethrough with a first and a second end forming a containment means defining a closed volume within a wall;

said capillary having a plurality of variable size perforations through said wall; and means for covering said perforations and for separating said fuel and said propellant mass.

4. The electrothermal-chemical impulse propulsion system of claim 3 wherein said means for covering separates contiguous chambers.

5. The electrothermal-chemical impulse propulsion system of claim 4 wherein said means for covering isolates plasma discharge outlets from said capillary, said fuel and said propellant mass.

6. An electrothermal-chemical gun for accelerating a projectile in a bore of a barrel comprising:

a Pulse Forming Network (PFN) for creating a plasma discharge;

a capillary having a wall and a bore therethrough containing the plasma discharge;

said capillary further having a first end and a second end;

an anode and a cathode electrodes disposed at said first and said second end;

means for establishing plasma flow across said electrodes;

said capillary being in communication with a hollow tube having variable size perforations along a surface, and extending into a combustible mass; and means for discharging plasma from said capillary into said hollow tube.

7. The electrothermal-chemical gun of claim 6 further having means for separating and isolating said capillary, said hollow tube and said combustible mass.

8. The electrothermal-chemical gun of claim 6 wherein said hollow tube comprises an open end in addition to said variable size perforations.

9. The electrothermal-chemical gun of claim 8 wherein said hollow tube comprises means for covering said open end and said perforations.

10. The electrothermal-chemical gun of claim 6 wherein said hollow tube is positioned within said combustible mass to enable plasma to flow radially and axially with respect to said bore.

11. The electrothermal-chemical gun of claim 6 wherein said means for discharging plasma into said hollow tube includes a nozzle.

12. An electrothermal-chemical gun for accelerating a projectile in a bore of a barrel comprising:

a Pulse Forming Network (PFN) for creating a plasma discharge;

a capillary having a wall and a bore therethrough containing the plasma discharge;

said capillary further having a first end and a second end;

an anode and a cathode electrodes disposed at said first and said second end;

a fuse wire connecting said electrodes;

said capillary having a plurality of variable size perforations through said wall;

means for covering said perforations and for separating said capillary from a fuel chamber and a propellant chamber; and means for dividing said fuel chamber and said propellant chamber.

13. The electrothermal-chemical gun of claim 12 wherein said first and second ends include means for containing plasma under pressure.

14. The electrothermal-chemical gun of claim 12 wherein said means for covering is applied to said means for dividing the fuel and propellant chamber.

15. The electrothermal-chemical gun of claim 12 wherein said means for dividing includes a plurality of orifices establishing a communication between the capillary and the propellant chamber, and the fuel and propellant chambers.

16. The electrothermal-chemical gun of claim 12 wherein said means for covering is rupturable under pressures created by said plasma discharge.

17. An electrothermal-chemical gun for accelerating a projectile in a bore of a barrel comprising:

a Pulse Forming Network (PFN) for creating a plasma discharge;

a capillary having a wall and a bore therethrough containing the plasma discharge;

said capillary further having a first end and a second end whereat an anode and a cathode electrode are located;

means for establishing plasma flow across said electrodes;

means for deflecting plasma flow disposed at said end whereat the cathode electrode is disposed;

said capillary having variable size perforations and extending into a combustible mass; and means for covering said perforations and for separating said capillary and said combustible mass.

18. The electrothermal-chemical gun of claim 17 wherein said capillary forms a closed structure to confine plasma pressure.

19. The electrothermal-chemical gun of claim 17 wherein said variable size perforations direct plasma discharge in a direction having radial and axial components with respect to the bore of the barrel.

20. The electrothermal-chemical gun of claim 17 wherein said means for covering the perforations retains the plasma pressure until sufficient energy levels are attained within said capillary.

21. The electrothermal-chemical gun of claim 17 wherein the anode electrode is sealably disposed at said end of the capillary.

22. The electrothermal-chemical gun of claim 17 wherein the cathode electrode is integrally disposed with said means for plasma flow deflection at said end of the capillary.

23. An electrothermal-chemical gun for accelerating a projectile in a bore of a barrel comprising:

a Pulse Forming Network (PFN) for creating a plasma discharge;

contiguous chambers containing air, fuel and propellant;

said air chamber defined by a closed wall, including a first and a second end whereat an anode and a cathode electrodes are disposed and further includes means for establishing plasma flow between said electrodes;

said air chamber further having variable size perforations along a surface of said wall;

said fuel chamber defined by a closed wall and having a first end and a second end, and proximately disposed to said air chamber;

said fuel chamber further having variable size perforations along a surface of the wall in staggered relations to said perforations in said air chamber;

means for enclosing said air chamber and said fuel chamber at said ends to thereby contain plasma pressure;

said propellant chamber proximately disposed to said fuel chamber; and means for separating and isolating said air, said fuel and said propellant chambers.

24. The electrothermal-chemical gun of claim 23 wherein said variable size perforations direct plasma discharge and plasma-ignited chemical in a direction having radial and axial components with respect to the bore of the barrel.

25. The electrothermal-chemical gun of claim 23 wherein said means for separating and isolating includes ablative layers on the interior and exterior surfaces of the walls of said air and fuel chambers.

* * * * *